United States Patent [19]

Obsomer

[11] 4,174,782

[45] Nov. 20, 1979

[54] HOLLOW BODY MADE FROM A THERMOPLASTIC

[75] Inventor: Marc Obsomer, Brussels, Belgium

[73] Assignee: Solvay & Cie, Brussels, Belgium

[21] Appl. No.: 875,502

[22] Filed: Feb. 6, 1978

[30] Foreign Application Priority Data

Feb. 4, 1977 [LU] Luxembourg ..... 76704
Mar. 29, 1977 [LU] Luxembourg ..... 77042

[51] Int. Cl.[2] ..... B65D 23/00; B65D 7/42

[52] U.S. Cl. ..... 215/1 C; 220/70; 428/35

[58] Field of Search ..... 215/1 C; 220/70; 428/35

[56] References Cited

U.S. PATENT DOCUMENTS

| | | | |
|---|---|---|---|
| 3,403,804 | 10/1968 | Colombo | 215/1 C |
| 3,498,908 | 12/1969 | Donovan | 150/0.5 |
| 3,870,181 | 3/1975 | Sincock | 215/1 C |
| 4,024,975 | 5/1977 | Uhlig | 215/1 C |
| 4,108,324 | 8/1978 | Krishnakumar et al. | 215/1 C |
| 4,134,510 | 1/1979 | Chang | 215/1 C |

FOREIGN PATENT DOCUMENTS

| | | | |
|---|---|---|---|
| 112776 | 9/1939 | Australia | 215/1 C |
| 1119542 | 4/1956 | France . | |

*Primary Examiner*—William R. Dixon, Jr.
*Attorney, Agent, or Firm*—Spencer & Kaye

[57] ABSTRACT

A hollow container of molecularly oriented thermoplastic material having a generally cylindrical form and provided with a base constituted by a series of annular toroidal sections of semicircular cross section and having alternating directions of curvature.

16 Claims, 7 Drawing Figures

HOLLOW BODY MADE FROM A THERMOPLASTIC

BACKGROUND OF THE INVENTION

The present invention relates to a hollow body made of an oriented thermoplastic material, such as a bottle or similar article, which exhibits improved mechanical properties and in particular improved impact strength.

It is known that the mechanical properties of hollow bodies made of a thermoplastic can be improved substantially by producing the bodies under such conditions that the molecules of the thermoplastic constituting their walls are oriented, preferably along two orthogonal directions, i.e. are bidirectionally oriented.

In general, in order to achieve this molecular orientation, a preform made from a thermoplastic is first produced, the dimensions of which perform are markedly less than those of the desired oriented hollow body, and subsequently, after having conditioned this preform at a temperature which favors orientation of the thermoplastic by stretching, the desired hollow body is blown, causing longitudinal stretching and radial stretching of the preform.

The oriented hollow bodies thus obtained exhibit a mechanical strength which is markedly improved, to the point that the bodies can generally be used for packaging carbonated drinks under pressure. For this application, it is desirable to impart a suitably chosen shape to the base of the hollow bodies so that their deformation under the effect of the internal pressure in the region of their base does not detract from their stability when standing in an upright, or vertical, position.

Furthermore, it is known that oriented hollow bodies made from a thermoplastic frequently possess an impact strength, in the region of their base, which leaves something to be desired.

Consequently, it has not proven easy to arrive at a shape for the base of hollow bodies made of an oriented thermoplastic which results in both good resistance to deformation of the base and satisfactory impact strength.

SUMMARY OF THE INVENTION

It is an object of the present invention to provide just such a shape for the bases of hollow bodies made from an oriented thermoplastic which makes it possible at one and the same time to achieve good resistance to deformation and good impact strength.

Hence, the present invention relates to a hollow body made from an oriented thermoplastic, the body being of generally cylindrical shape, while the base is oriented and is defined by at least 3 concentric semitoroidal sections each of substantially semicircular cross section, alternatingly upwardly concave and upwardly convex from the periphery inwards.

Thus, the base of the hollow body according to the invention possesses, at its periphery, an annular downwardly projecting section, or upwardly concave semitorus, whose outline is a semicircle and which joins onto the lateral surface, or wall, of the hollow body towards the periphery. while towards the center it joins onto an annular hollow upwardly projecting section, or upwardly convex semi-torus, whose outline is also a semicircle. Towards the center, this latter section joins onto another annular downwardly projecting section having the same form as the first section. This alternation may be continued with other sections towards the center.

The central section of the base can advantageously have a hemispherical shape, which may project downwardly, but preferably projects upwardly. In this latter case, it then joins, towards the periphery of the body, onto an upwardly concave, i.e. downwardly projecting, section. thus, the base of the hollow body is such that any cut made along a plane perpendicular to the base and passing through its center yields a sinuous profile of which the waves are semicircular or semielliptical.

Preferably, the number of alternating sections from the central section to the periphery is not greater than 15.

It is also preferred that the diameter of the cross section of each semicircular annular section should be less than 20% of the maximum diameter of the cylindrical part of the hollow body.

The ratio of the maximum diameter of the cylindrical part of the oriented hollow body according to the invention to the developed length of the profile of its base along an intersection of this base with a plane perpendicular to that base and passing through its center in general varies between 0.8 and 0.5. Preferably it is between 0.75 and 0.6.

According to a preferred embodiment, the base of the hollow body according to the invention is of generally downwardly concave, or recessed, shape with the centrally disposed concentric annular sections being set back relative to the peripheral annular section. In this case, the hollow body is thus of the reentrant base type and, when in its vertical position, rests solely on the peripheral annular section.

The general shape of such concave base is optional. However, it is preferred that this shape should be that of a spherical segment.

The semicircular cross sections of the various concentric annular sections of the base can all have the same diameter or can have respectively different diameters. It is preferred that the diameters be different and increase progressively from the center of the base.

According to another preferred embodiment, which makes it possible to engrave easily legible relief inscriptions on the base of the hollow body during its blow-molding, the alternation between two concentric annular sections of the base of the hollow body is interrupted by an annular section of rectilinear, or flat, cross section.

Applicant has in fact found that the presence of annular base sections of flat cross section in a hollow body according to the invention does not significantly affect the impact strength of this hollow body and that in certain cases this annular base section can even contribute, in an inherently surprising manner, to an increase in the resulting impact strength of the hollow body. Each annular section of flat cross section can be utilized, during molding of the hollow body, in order to engrave thereon relief inscriptions which are perfectly legible and which indicate, for example, the contents of the hollow body or the trade name of its producer, or which constitute an advertisement.

The number of annular base sections of flat cross section is optional but in general applicant prefers that the base of a body according to the invention should be provided with only one such annular section. In this case, applicant prefers that this annular section should be closer to the periphery of the base than to the center of the latter.

There are numerous possible methods of producing an annular base section of flat cross section on the base of the hollow body.

Thus, according to a first embodiment, this section can be arranged between consecutive and concentric upwardly concave and convex base sections.

According to another embodiment, the rectilinear annular section can replace an upwardly convex section of the base and be joined to two consecutive upwardly concave sections.

According to a third embodiment, the annular section of flat cross section can replace an upwardly concave section of the base and be joined to two consecutive upwardly convex sections.

The width of the annular section of flat cross section, in the direction of the radius of the base, is chosen in accordance with the relief inscription to be applied. However, applicant prefers that this width should be between 2 and 10% of the maximum diameter of the body of the hollow article.

The annular base section of flat cross section can be planar and located in a plane at right angles to the longitudinal axis of the hollow body, for example if the base has a generally planar shape, in which case this section is in the shape of a planar ring. It can also be other than planar, such that its linear, radially-extending generatrices form an angle relative to the said longitudinal axis, for example if the base is of reentrant base type, and in that case the annular section is in the shape of a conic frustum.

The hollow body made of an oriented thermoplastic, in accordance with the invention, can be produced from any thermoplastic provided the latter can be molecularly oriented by stretching at a suitably chosen temperature. By way of non-limiting examples there may be mentioned resins based on vinyl chloride, polymers and copolymers produced from $\alpha$-olefines containing up to 8 carbon atoms in their molecule, acrylic polymers and copolymers and especially those produced from acrylonitrile, polyesters such as poly(ethylene glycol terephthalate) and polycarbonates.

DESCRIPTION OF THE PREFERRED EMBODIMENTS

Figure 1:
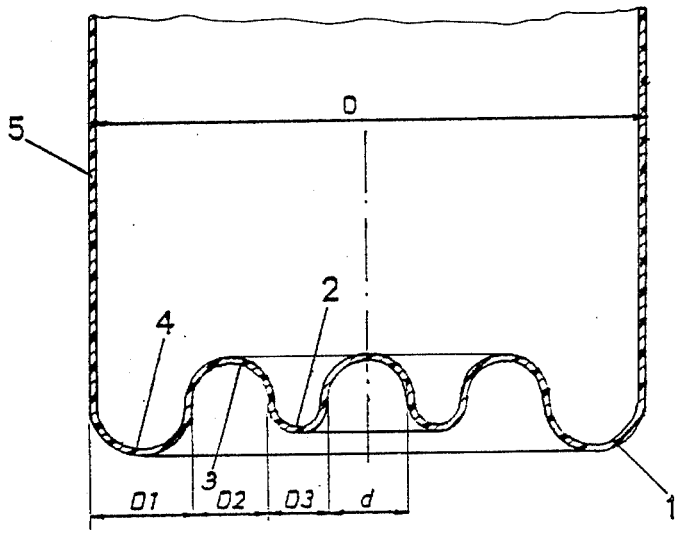
FIGS. 1 to 6 are elevational, cross-sectional detail views of the base portions of embodiments of hollow bodies according to the invention.

As is apparent from FIGS. 1–6, the hollow body according to the invention is constituted by a wall having an internal surface 2 and external surface 3. It is provided with a base 1 consisting respectively of 3, 13, 5, 5, 9 and 7 successive concentric annular sections of semicircular cross section. The base has a peripheral upwardly concave section 4 which may or may not be joined directly onto the cylindrical side wall 5 of the hollow body. The diameter of the semicircular cross section of each of the concentric annular sections is always less than 20% of the maximum diameter D of the cylindrical part of the hollow body.

In the embodiment shown in FIG. 1, the base is of the reentrant type and the diameters of the semicircular cross sections of the concentric annular sections increase progressively going from the center of the base.

Figure 2:
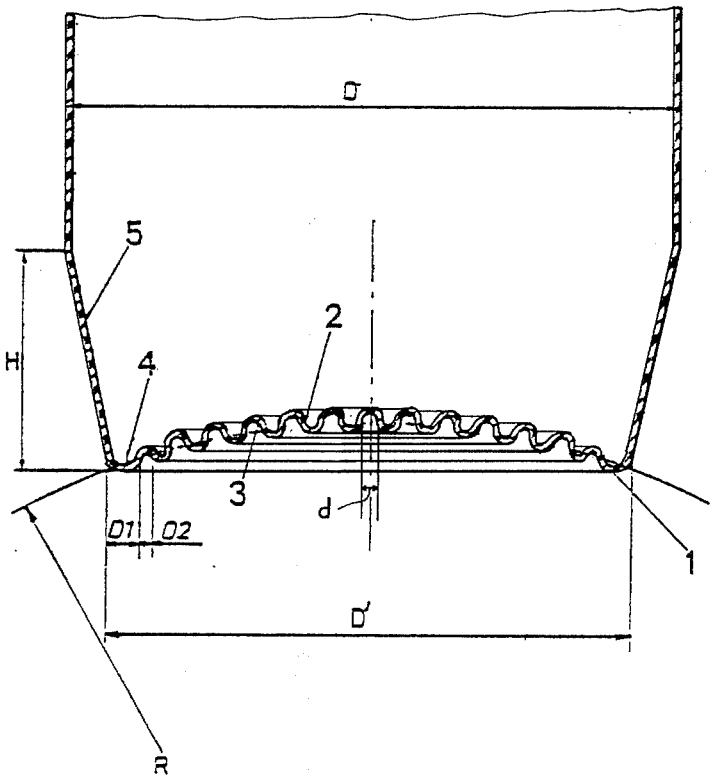

In FIG. 2, the portion of said wall 5 adjacent base 1 tapers inwardly toward the bottom and the base is also of the reentrant type and the diameters of the sections are all virtually equal, except for that of the peripheral, upwardly concave, section 4, which has a somewhat larger diameter.

Figure 3:
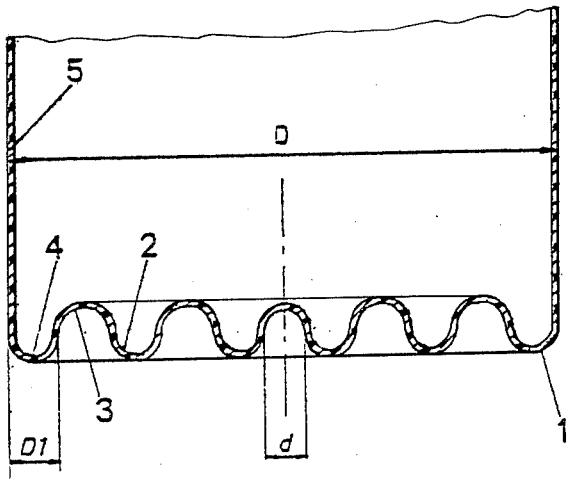

In FIG. 3 the base is generally flat and the diameters of the semicircular cross sections of the toroidal sections are equal.

Figure 4:
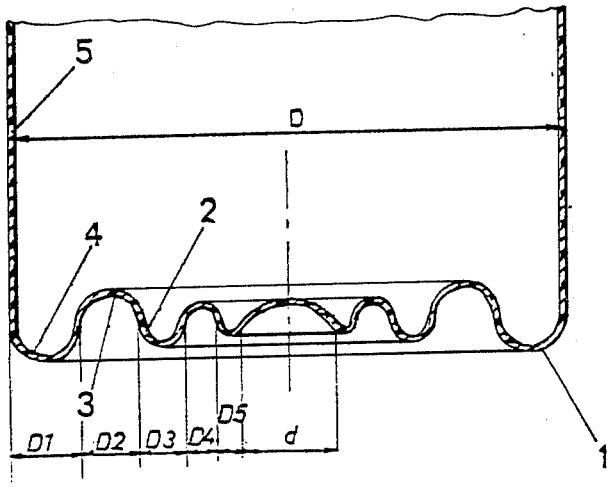

In FIG. 4 the base is of the reentrant type and the diameters of the semicircular cross sections of the sections increase from the center of the base.

Figure 5:
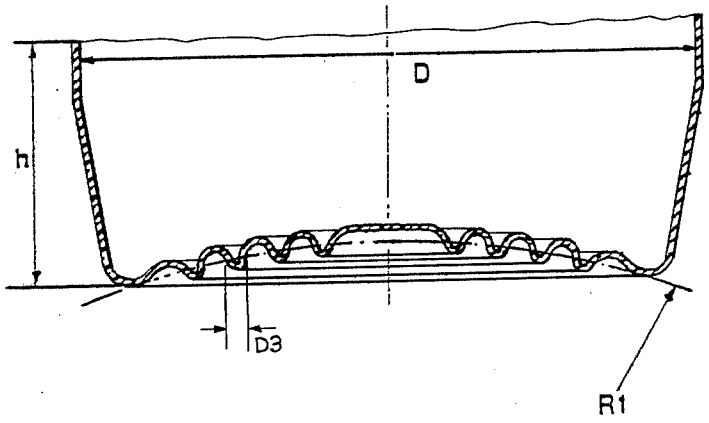

In FIG. 5 the lower portion of side wall 5 has the same form as that of FIG. 2 and the base is again of the reentrant type and the diameters of the semicircular cross sections of the sections are equal.

Figure 6:
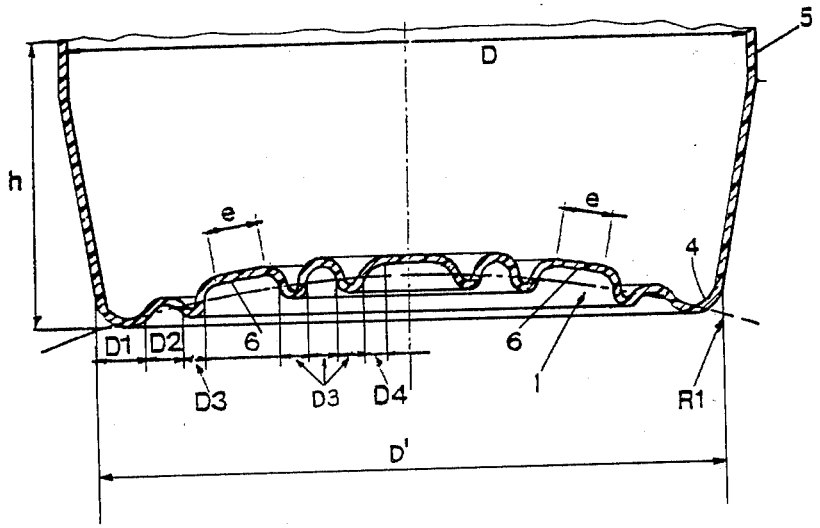

In FIG. 6 the lower portion of side wall 5 and the base 1 are similar to that shown in FIG. 5, except that this base is provided with an annular wall section 6 of linear cross section which replaces one of the annular upwardly concave sections and which is joined onto two successive upwardly convex annular sections, these two latter sections each thus having a cross section in the form of a quarter of a circle.

In the embodiment shown in each of FIGS. 1 to 3, the central section of the base has the general shape of an upwardly convex hemisphere, while in FIG. 4 the general shape is that of an upwardly convex segment of a spherical surface, and in FIGS. 5 and 6 the shape is that of a flattened, upwardly projecting dome.

These figures are presented by way of illustration and without implying any limitation, because the hollow body according to the invention can be subjected to numerous modifications both as regards the number of concentric annular sections and as regards the diameters of the semicircular cross sections of these sections.

Figure 7:
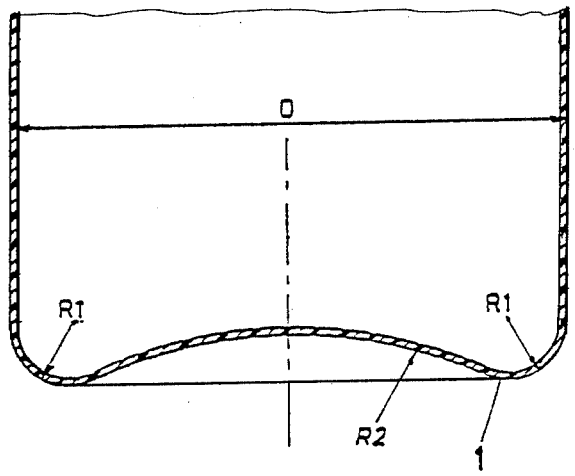
FIG 7 (PRIOR ART)
FIG. 7 is a similar view of a hollow body according to the prior art.

In order better to show the advantages achieved by means of the oriented hollow body according to the invention, series of oriented bottles having a capacity of 1,250 cc were produced, the bottles being provided with bases as shown in the attached FIGS. 1 to 4 or with a conventional base as shown in FIG. 7. The base shown in FIG. 7 thus does not lie within the scope of the present invention.

The thermoplastic employed is rigid polyvinyl chloride. The specific thermplastic composition and the manufacturing conditions, in particular the parameters which control the orientation, are the same for all the series of bottles. The weight of each bottle is about 65 g.

The principal dimensions of the bottles produced in accordance with the attached figures are given below:

| | | | | | | |
|---|---|---|---|---|---|---|
| FIG. 1 : | D | = | 86.7 | mm | | |
| | D1 | = | 16 | mm | | |
| | D2 | = | 12 | mm | | |
| | D3 | = | 9.5 | mm | | |
| | d | = | 13 | mm | | |
| FIG. 2 : | D | = | 86.7 | mm | D′ = 72 mm | H = 35.5 mm |
| | D1 | = | 6 | mm | | |
| | D2 | = | 2 | mm | | |
| | d | = | 3 | mm | | |
| | R | = | 120 | mm | | |
| FIG. 3 : | D | = | 86.7 | mm | | |
| | D1 | = | 8 | mm | | |
| | d | = | 7 | mm | | |
| FIG. 4 : | D | = | 86.7 | mm | | |
| | D1 | = | 11 | mm | | |
| | D2 | = | 9 | mm | | |
| | D3 | = | 7 | mm | | |
| | D4 | = | 4.5 | mm | | |

-continued

| | | | | |
|---|---|---|---|---|
| | D5 | = | 4 | mm |
| | d | = | 18 | mm |
| FIG. 7 : | D | = | 86.7 | mm |
| | R1 | = | 9 | mm |
| | R2 | = | 75 | mm |

The series of bottles thus fabricated were subsequently filled with liquid and sealed and subjected to a large variety of impact strength tests, of which the results are summarized in Table I below:

TABLE I

| TEST | | | BASE AS SHOWN IN FIG. 1 | FIG. 2 | FIG. 3 | FIG. 4 | FIG. 7 |
|---|---|---|---|---|---|---|---|
| Free drop | | 1 m | 10 | 30 | 40 | 0 | 40 |
| | | 2 m | 20 | 60 | 55 | 60 | 80 |
| Guided drop onto a base inclined at 5°: | height: | 1 m | 0 | 10 | 50 | 0 | 30 |
| | height: | 2 m | 20 | 80 | 20 | 30 | 50 |
| Sideways drop | | 1 m | 30 | 10 | 50 | 0 | 50 |
| Drop from a table of | height: | 90 cm | 40 | 20 | 20 | 30 | 70 |
| Oblique drop at 30° | | 40 cm | 0 | 0 | 0 | 0 | 0 |
| Performance index | | | 83 | 70 | 69 | 82 | 60 |

The numbers indicated for the various tests give the percentage of bottles broken during the tests, each test having been carried out on 20 specimens of each embodiment.

The performance index is obtained by adding the percentage of bottles not broken during the 7 types of tests carried out, and dividing this sum by 7.

It is noted immediately that the hollow bodies, made from an oriented thermoplastic, in accordance with the invention (FIGS. 1 to 4) exhibit a performance index which is markedly improved relative to the oriented hollow bodies of conventional shape (FIG. 7).

In order to show that the presence of an annular section of rectilinear cross section in the base of hollow bodies according to the invention does not present the danger of diminishing the mechanical properties of these hollow bodies, series of oriented bottles of capacity 1,250 cc provided with a base according to FIG. 6 and a base such as that shown in FIG. 5, respectively, were also produced from the same composition and by the same procedure as those employed for the first-described series of bottles. The base shown in FIG. 6 is identical to that of FIG. 6 apart from the fact that the annular section 6 of rectilinear cross section in FIG. 6 is replaced in the embodiment of FIG. 5 by an upwardly concave annular section having a semicircular cross section.

Finally, a series of bottles of capacity 1,250 cc equipped with a conventional base as shown in FIG. 7, and having the dimensions which have been given above was also produced.

The thermoplastic employed is rigid polyvinyl chloride. The working conditions, in particular the parameters controlling molecular orientation, are the same for all the series of bottles. The weight of each bottle is about 65 g.

The principal dimensions of the bottles produced are given below.

| | | | | | | | | |
|---|---|---|---|---|---|---|---|---|
| FIG. 6 : | D | = | 86.7 | mm | h | = | 35.5 | mm |
| | D1 | = | 8 | mm | R1 | = | 121 | mm |
| | D2 | = | 6 | mm | e | = | 6 | mm |
| | D3 | = | 3 | mm | D' | = | 72 | mm |

-continued

| | | | | |
|---|---|---|---|---|
| | D4 | = | 6 | mm |

FIG. 5

The dimensions are identical to those of the bottles according to FIG. 6, except that the annular section 6 is replaced by a section of diameter D3=3 mm.

The series of bottles thus obtained were subsequently filled and sealed and subjected to impact strength tests, the results of which are summarized in Table II below:

TABLE II

| TEST | | BASE AS SHOWN IN FIG. 6 | FIG. 5 | FIG. 7 |
|---|---|---|---|---|
| Free drop | 1 m | 30 | 40 | 40 |
| | 2 m | 50 | 50 | 80 |
| Drop from a table of height : | 90 cm | 60 | 80 | 70 |
| Oblique drop at 30°, | 40 cm | 0 | 0 | 0 |
| Performance index | | 65 | 57.5 | 52.5 |

The numbers indicated for the various test give the percentages of bottles broken during the tests, each of the various tests having been carried out on 20 specimens of each embodiment.

The performance index is obtained by adding the percentages of bottles not broken during the four tests and dividing this sum by 4.

It is noted immediately that the hollow body, made from an oriented thermoplastic, in accordance with the invention (FIG. 6) exhibits a performance index which is markedly improved relative to an oriented hollow body of conventional shape (FIG. 7). It is also noted, on comparing the tests relating to the bases according to FIGS. 5 and 6, that the presence of an annular base section 6 of rectilinear cross section (FIG. 6) results, contrary to all expectations, in an improvement in the impact strength.

The hollow bodies according to the invention, as exemplified in FIGS. 1 to 6, are particularly suitable for packaging noncarbonated waer for the table, e.g. mineral water, spring water, etc., carbonated drinks such as beer, and lemonades.

It will be understood that the above description of the present invention is susceptible to various modifications, changes and adaptations, and the same are intended to be comprehended within the meaning and range of equivalents of the appended claims.

What is claimed is:

1. In a hollow body made of an oriented thermoplastic material, which body is of generally cylindrical shape and includes a base and a side wall, the improvement wherein said base is oriented and is constituted by between three and 15 concentric annular toroidal sections of substantially semicircular cross section and having alternating directions of curvature from the periphery of said body inwards wherein the radially outermost one of said base sections is upwardly concave and joins directly onto said side wall of said hollow body and the diameter of the cross section of each of said annular sections is less than 20% of the maximum diameter of said side wall.

2. An article as defined in claim 1 wherein the ratio of the maximum diameter of said side wall part to the developed length of the profile of said base along an intersection of said base with a plane perpendicular to said base and passing through its center is between 0.8 and 0.5.

3. An article as defined in claim 1 wherein those of said base sections near the center of said body are recessed relative to said radially outermost base section.

4. An article as defined in claim 3 wherein the general shape of the recessed portion of said base is concave.

5. An article as defined in claim 4 wherein the general shape of the recessed portion of said base is that of a spherical segment.

6. An article as defined in claim 1 wherein the diameters of the semicircular cross sections of all of said annular sections are equal.

7. An article as defined in claim 1 wherein the diameters of the semicircular cross sections of said annular sections increase progressively from the center of said base outwards.

8. An article as defined in claim 1 wherein said base is further constituted by an annular section of rectilinear cross section interposed between two of said annular toroidal sections of semicircular cross section.

9. An article as defined in claim 8 wherein said base possesses only a single such annular section of rectilinear cross section.

10. An article as defined in claim 8 wherein said annular section of rectilinear cross section is located between an upwardly concave and an upwardly convex section of semicircular cross section.

11. An article as defined in claim 8 wherein said annular section of rectilinear cross section is located between two upwardly concave sections of semicircular cross section.

12. An article as defined in claim 8 wherein said annular section of rectilinear cross section is located between two upwardly convex sections of semicircular cross section.

13. An article as defined in claim 8 wherein the width of said annular section of rectilinear cross section is between 2 and 10% of the maximum diameter of said side wall.

14. An article as defined in claim 8 wherein said annular section of rectilinear cross section is planar and is located in a plane which is perpendicular to the longitudinal axis of said hollow body.

15. An article as defined in claim 8 wherein said annular section of rectilinear cross section is in the form of a conic frustum.

16. An article as defined in claim 1 wherein the central portion of said base has a generally hemispherical, upwardly convex form.

* * * * *